US006033528A

United States Patent [19]

Sakawa et al.

[11] Patent Number: 6,033,528

[45] Date of Patent: Mar. 7, 2000

[54] PROCESS FOR MAKING BLAST FURNACE COKE

[75] Inventors: Mitsuhiro Sakawa; Masaki Sasaki; Makoto Matsuura; Ikuo Komaki; Kenji Kato, all of Futtsu, Japan

[73] Assignee: The Japan Iron and Steel Federation, Tokyo, Japan

[21] Appl. No.: 08/718,566

[22] PCT Filed: Feb. 2, 1996

[86] PCT No.: PCT/JP96/00226

§ 371 Date: Jan. 13, 1997

§ 102(e) Date: Jan. 13, 1997

[87] PCT Pub. No.: WO96/23852

PCT Pub. Date: Aug. 8, 1996

[30] Foreign Application Priority Data

Feb. 2, 1995 [JP] Japan ..... 7-15959
Mar. 24, 1995 [JP] Japan ..... 7-65414

[51] Int. Cl.[7] ..... C10B 57/04; C10B 57/08

[52] U.S. Cl. ..... 201/1; 44/591; 44/599; 44/607; 201/6; 201/8; 201/21; 201/24; 201/41; 201/44; 201/45

[58] Field of Search ..... 201/1, 5, 6, 18, 201/21, 24, 22, 36, 45, 8, 44, 41; 44/591, 599, 607; 209/1, 2

[56] References Cited

U.S. PATENT DOCUMENTS

| | | | |
|---|---|---|---|
| 4,178,215 | 12/1979 | Kiritani et al. | 201/6 |
| 4,201,655 | 5/1980 | Theodore et al. | 201/22 |
| 4,259,083 | 3/1981 | Ignasiak | 201/24 |
| 4,318,779 | 3/1982 | Tsuyuguchi et al. | 201/6 |
| 4,370,201 | 1/1983 | Lowenhaupt | 201/24 |

FOREIGN PATENT DOCUMENTS

| | | |
|---|---|---|
| 0012457 | 11/1979 | European Pat. Off. . |
| 212168 | 8/1994 | Japan . |
| 102260 | 4/1995 | Japan . |
| 7-118661 | 5/1995 | Japan . |
| 166166 | 6/1995 | Japan . |
| 245965 | 9/1996 | Japan . |
| 255967 | 9/1997 | Japan . |

OTHER PUBLICATIONS

Cokusu Noto (Coke Note), Fuel Society of Japan, 1988, pp. 134–135.

Coal (Elsevier), by D.W. Van Krevelen, p. 693.

*Primary Examiner*—Virginia Manoharan
*Attorney, Agent, or Firm*—Kenyon & Kenyon

[57] ABSTRACT

A blast furnace coal is produced by rapidly heating a coal blend having 10 to 30% by weight of a non-slightly-caking coal having softening initiation temperature T with the balance including a caking coal having softening initiation temperature $T_0$ ($T_0 \leqq T + 40°$ C.) at a rate of $1\times10^3$ to $1\times10^{6°}$ C./min to a temperature region from (T −60° C.) to (T +10° C.) wherein T represents the softening initiation temperature of the non-slightly-caking coal; or rapidly heating a non-slightly-caking coal having softening initiation temperature T and a caking coal having softening initiation temperature $T_1$ separately at a rate of $1\times10^3$ to $1\times10^{6°}$ C./min to a temperature region from (T −100° C.) to (T +10° C.), wherein T represents the softening initiation temperature of the non-slightly-caking coal, or a temperature region from ($T_1$−100° C.) to ($T_1$+10° C.), wherein $T_1$ represents the softening initiation temperature of the caking coal, blending the heated non-slightly-caking coal with the heated caking coal to prepare a coal blend having 10 to 30% by weight of the non-slightly-caking coal with the balance including the caking coal; and charging the coal blend into a coke oven where the coal blend is carbonized.

5 Claims, 5 Drawing Sheets

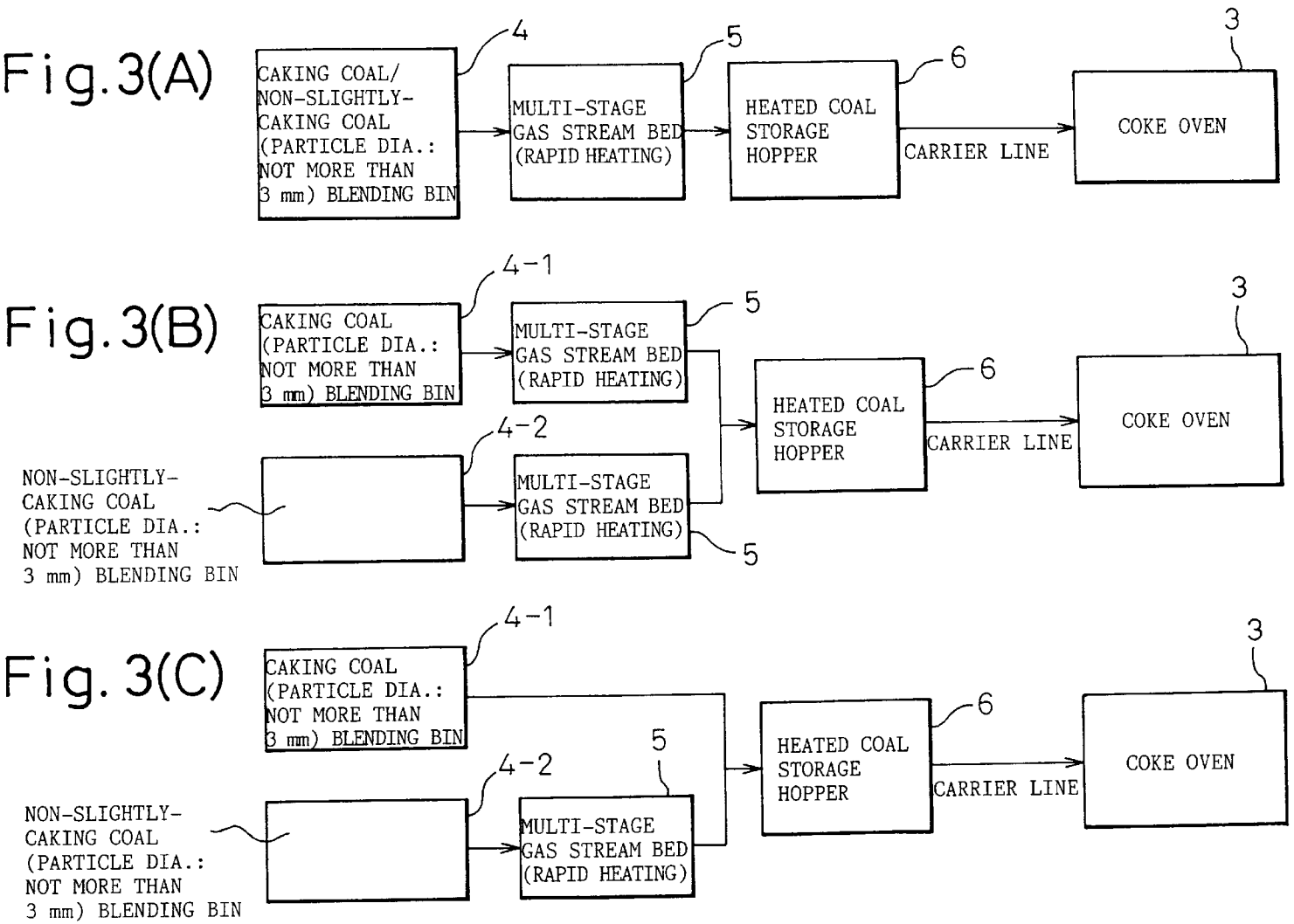
Fig.3(A)
CAKING COAL/ NON-SLIGHTLY-CAKING COAL (PARTICLE DIA.: NOT MORE THAN 3 mm) BLENDING BIN
4
MULTI-STAGE GAS STREAM BED (RAPID HEATING)
5
HEATED COAL STORAGE HOPPER
6
CARRIER LINE
COKE OVEN
3
Fig.3(B)
CAKING COAL (PARTICLE DIA.: NOT MORE THAN 3 mm) BLENDING BIN
4-1
MULTI-STAGE GAS STREAM BED (RAPID HEATING)
5
NON-SLIGHTLY-CAKING COAL (PARTICLE DIA.: NOT MORE THAN 3 mm) BLENDING BIN
4-2
MULTI-STAGE GAS STREAM BED (RAPID HEATING)
5
HEATED COAL STORAGE HOPPER
6
CARRIER LINE
COKE OVEN
3
Fig.3(C)
CAKING COAL (PARTICLE DIA.: NOT MORE THAN 3 mm) BLENDING BIN
4-1
NON-SLIGHTLY-CAKING COAL (PARTICLE DIA.: NOT MORE THAN 3 mm) BLENDING BIN
4-2
MULTI-STAGE GAS STREAM BED (RAPID HEATING)
5
HEATED COAL STORAGE HOPPER
6
CARRIER LINE
COKE OVEN
3

PROCESS FOR MAKING BLAST FURNACE COKE

TECHNICAL FIELD

The present invention relates to a process for making a blast furnace coke. More particularly, the present invention relates to a process for making a blast furnace coke, which can expand the kinds of coal usable for coke making, so as to cope with the diversification of coal resources and, at the same time, can improve the productivity of the coke and the profitability of the coke making process and can reduce the cost of equipment.

BACKGROUND ART

A blast furnace coke has hitherto been produced using, for example, a system schematically shown in FIG. 1. A coal, which has been previously pulverized and subjected to size control, is first transferred to a coal blending bin 1 and charged through a coal charging car 2 provided above a coke oven 3 into a coke oven chamber of the coke oven 3 of which the wall has been heated to 900 to 1100° C. The temperature of the coal at the time of charge is 20 to 30° C. Since the width of the coke oven chamber is about 400 mm and the thermal conductivity of the coal is very small, the average temperature rise rate of the coal within the coke oven chamber is as low as 3° C./min. Therefore, in this conventional coke making process, a long period of time of 14 to 20 hr is required as the coking time. Thus, the conventional process posed problems of very low productivity and large energy consumption.

Further, in the above conventional blast furnace coke making process, a heavy caking coal has mainly been used for coke making due to the restriction of the quality of the blast furnace coke, making it difficult to expand the kinds of coal usable to coke making. In particular, a non-coking coal is more inexpensive than a caking coal, and the reserves thereof on earth are abundant. The use of such non-caking coal in a large amount leads to an improvement in profitability. However, blending of the non-caking coal as a coal for coke making in an amount of not less than 10% by weight unfavorably results in lowered coke strength.

Shortening the coking time by reducing the oven width is possible as means for improving the productivity. In this method, however, the amount of coal charge per chamber is reduced, making it impossible to improve the productivity of coke. On the other hand, increasing the coke oven length poses a problem of the difficulties of achieving even heating in the horizontal direction of the oven and a problem of the difficulties of discharging (pushing) coke after carbonization from the coke oven chamber. Such measures cannot markedly improve the productivity of coke.

Another method of shortening the coking time is to raise the temperature of a combustion flue provided on both sides of the coke oven chamber. However, due to a limitation on the material of bricks for the combustion chamber, there is a limit to the rise of the combustion flue temperature.

On the other hand, in order to shorten the coking time in the production of a blast furnace coke, a process has been developed wherein a coal for coke making is predried and preheated and then charged into a coke oven to shorten the coking time and to improve the charge density, enabling the quality of coke to be improved. For example, there is a precarbon method wherein a coal for coke making is preheated to about 200° C. and then charged into a coke oven where the preheated coal is carbonized. In this connection, the preheating method and the method for carbonization in a coke oven are reported in Cokusu Noto (Coke Note) (Fuel Society of Japan, 1988), p. 134 and the like. In the precarbon method, the coal is preheated in order to improve the coking speed in the coke oven, that is, to improve the productivity of coke. The preheating temperature of the coal is low and about 180 to 230° C. at the highest. An improvement in productivity of the coke is only 35% over the process not involving the step of preheating.

In order to markedly improve the productivity of coke and, at the same time, to diversify the coal usable for coke making, Japanese Unexamined Patent Publication (Kokai) No. 07-118661 proposes a process wherein a coal is preheated to 350 to 400° C. and charged into a coke oven where the preheated coal is carbonized. In this method, however, the coal is merely heated to a high temperature, and it is difficult to markedly improve the caking property of the non-slightly-caking coal.

With this background, the development of a process wherein a coal is preheated to a high temperature and the caking property of the coal is improved by the preheating, making it possible to use a non-slightly-caking coal in a large proportion in the coal for blast furnace coke making and, at the same time, to markedly improve the productivity, has been desired in the art.

DISCLOSURE OF INVENTION

An object of the present invention is to solve the above problem of the prior art and to provide a process which can markedly improve the caking property of a non-slightly-caking coal.

Another object of the present invention is to provide a process which enables a non-slightly-caking coal to be used in a large proportion as a coal for blast furnace coke making.

In order to provide the above processes, the present inventors first made various studies on the caking property of coal.

Coal is a high-molecular substance comprising aromatic compounds and aliphatic compounds complicatedly bonded to one another. In particular, the aromatic compounds constituting the skeleton of the coal are aromatic polycyclic compounds, and the size thereof is considered to be about 2 to 6 rings. These aromatic compounds are covalently bonded to aliphatic chains (alkyl group, cyclo ring and the like), or are non-covalently bonded to each other or one another by π—π bond, van der Waals force, or hydrogen bond, such as a hydroxyl group or carboxyl group.

In the course of the heating through which coal is converted to coke, breaking and recombination of the individual bonds are repeated to form a polycyclic aromatic compound. Specifically, when the coal is heated at a temperature rise rate of about 3° C./min, moisture is released at a temperature of about 80° C. or above. Thereafter, when the temperature reaches about 200° C. or above, the non-covalent bonds, such as hydrogen bond, are broken to release moisture and carbon dioxide. In this case, for example, water is produced from two hydroxyl groups resulting in the recombination of the unit structure with other unit structure through the remaining oxygen. Thereafter, when the temperature reaches about 380° C. or above, the alkyl group and the hydroxyl group are decomposed to release methane, and at higher temperatures, aromatic compounds having a relatively low molecular weight, such as tar, are released. Also in this case, these bonds are broken to release a product, while the remaining high-molecular portions are recombined with each other to produce a polycyclic aromatic compound. Further, when the temperature reaches 600° C. or above, carbon monoxide and hydrogen are released with polycyclic aromatic compounds condensed to larger polycyclic aromatic compounds, thus resulting in the formation of coke. The coke strength is influenced by the size of the units and assembled state of polycyclic aromatic compounds, which are influenced by the kinds of coal (inherent structure of coal) and the state of the coal in the course of heating from about 400 to about 550° C. (i.e., from the thermal plastic temperature of the coal to the resolidification temperature).

In the course of heating from about 400 to 550° C. (i.e., from the thermal plastic temperature of the coal), the covalent bond is broken to release aromatic compounds having a relatively low molecular weight, such as methane and tar, and the fluidity of the coal is determined by the ease of thermal motion of a mixture of the residual high-molecular portions with these products. When the fluidity is good, unit structures of polycyclic aromatic compounds are assembled in a regular sequence, resulting in increased unit size.

The fact that the fluidity of the coal can be improved by increasing the heating rate is disclosed, for example, D. W. VANKREVELEN, COAL (ELSEVIER), page 693. In this case, the fluidity of the coal in the temperature range of from about 400 to 550° C. (i.e., from the softening melting temperature of the coal to the resolidification temperature) at a heating rate of about 7.2° C./min at the highest was examined.

On the other hand, the average heating rate of the coal in the coke oven chamber (in the temperature range of from 400 to 550° C.) of a conventional coke oven is 3° C./min at the highest. Therefore, in the production of coke in the coke oven, improving the fluidity of the coal by increasing the heating rate in the coke oven chamber of the coke oven according to the above disclosure is very difficult.

The present inventor has now found a phenomenon that, quite apart from the conventional concept of the improvement of the coal, rapid heating of the coal, before charging into a coke oven, at a rate of not less than 10° C./min to a temperature at which the coal becomes thermally plastic, or to a temperature 60 to 100° C. below this temperature, results in markedly improved fluidity of the coal.

When the coal before charging into the coke oven chamber is rapidly heated the thermal plastic temperature to the resolidification temperature, the fluidity (caking property) appears before charging into the coke oven chamber, adversely affecting the coking within the coke oven chamber. Therefore, the temperature range in which rapid heating is conducted is very important.

Specifically, according to the present invention, rapid heating of the coal under the above conditions relaxes the non-covalent bond in the coal structure (structural portion where aromatic compounds in the coal structure have been non-covalently connected to each other or one another by π—π bond, van der Waals force, or hydrogen bond, such as a hydroxyl group or carboxyl group), minimizes the recombination reaction, and accelerates the degradation in the course of subsequent heating at a temperature above the thermal plastic temperature of the coal (carbonization in the coke oven chamber), thereby increasing the fluidity of the coal and permitting the caking property to appear.

As a result of detailed studies on the heating temperature and heating rate of the coal, the present inventor has found that there is a clear relationship, as shown in FIG. 2, between the heating temperature and heating rate and the caking property of coal (coke strength), which has led to the finding of the above phenomenon.

FIG. 2 is a graph showing the strength of coke prepared by heating a non-slightly-caking coal, shown in Table 1, at varied heating rates to indicated temperatures ranging from 200 to 450° C. and then carbonizing the coal. From FIG. 2, it is apparent that heating of the non-slightly-caking coal at a heating rate of $1\times10^3$ to $1\times10^{6}$° C./min to a temperature region from (T −100° C.) to (T +10° C.) wherein T represents the softening initiation temperature (about 400° C.) of the coal provides coke strength exceeding the target value 80 $DI^{150}_{15}$%.

The caking property of the coal is a general term for properties such as agglutinating property observed in a thermal plastic state created upon heating of coal. Improving the caking property is a requirement for improving the coke strength.

It is noted that when the coal is heated to a high temperature of at least 10° C. above the softening initiation temperature of the coal or held at that temperature for a long period of time, the recombination reaction is accelerated and causes a caking component to be polymerized, resulting in semicoking. When the coal is charged in this state into a coke oven (a coke oven chamber), caking does not occur in the coke oven chamber, that is, combination of coal properties does not occur in the coke oven chamber, making it impossible to attain a desired coke strength. On the other hand, heating of the coal to a low temperature of a value of less than (the softening initiation temperature −100° C.), even though the rapid heating is applied, does not lead to the relaxation of the non-covalent bond of the coal structure, that is, the improvement in caking property of the coal, due to the excessively low temperature.

Thus, an improvement in a caking property of the coal by rapid heating can enhance the proportion of the non-slightly caking coal in the coal for making a blast furnace coke. That is, the upper limit of the proportion of the non-slightly-caking coal in the coal for coke making in the prior art, which is less than about 10% by weight, can be increased to 30% by weight while maintaining a substantially equal coke strength. The effect of rapid heating on the caking property of the coal varies depending upon the kind of coal used. This effect is significant when the caking property of the coal is poor. The effect of rapid heating can be attained also in the case of caking coal. However, a coal having a maximum fluidity log (MF/DDPM) of 2.5 to 4.5 as measured with a fluidity measuring device using Gieseler plastometer specified in JIS 8801 and an average vitrinite reflectance of 0.5 to 1.8, in some cases, causes foaming of particles due to excessive fluidity or the like, adversely affecting the coke strength. Therefore, rapid heating is often unnecessary for this coal. In the present invention, such coal is used in combination with the non-slightly-caking coal for which rapid heating is effective.

Caking coal, of which the caking property can be improved by rapid heating according to the present invention, is a coal having a log(MF/DDPM) of more than 2.0 to less than 2.5 and an average vitrinite reflectance of 0.5 to 2.0, or a coal having a log(MF/DDPM) of 0.3 to 2.0 and an average vitrinite reflectance of more than 1.0 to 2.0.

In order to increase the proportion of the non-slightly-caking coal used for coke making to 60% by weight, the present invention, besides the attainment of the rapid heating effect, aims to improve the caking property. The caking property can be improved by hot molding of a fine fraction of the coal used. The hot molding is effective also as measures for prevention of an environmental problem, such as scattering of a fine coal in the air during handling thereof. The fine fraction of the coal has a lower caking property than the coarse fraction, and, when molded into a molded coal, apparently coarsens the fine coal, restoring the caking property. Further, blending of the molded coal in a suitable proportion can improve the charge density of coal (density of coke), resulting in improved coke strength.

When a coal blend of a non-slightly-caking coal with a caking coal is rapidly heated, the softening initiation temperature T of the non-slightly-caking coal is used as the softening initiation temperature of the coal blend. In this case, the caking coal used should have a softening initiation temperature $T_0$ which does not exceed a temperature of 40° C. above the softening initiation temperature T of the non-slightly-caking coal. Therefore, the heating temperature of the coal blend is in the temperature range of from (T −60° C.) to (T +10° C.). Heating to the above temperature range is performed at a high heating rate of from $1\times10^3$ to $1\times10^{6}$° C./min.

When a non-slightly-caking coal and a caking coal are separately subjected to rapid heating, a non-slightly-caking coal having a softening initiation temperature T and a caking coal having a softening initiation temperature $T_1$ are used. In this case, the non-slightly caking coal and the caking coal are separately heated at a rate of $1\times10^3$ to $1\times10^{6}$° C./min to a temperature region from (T −100° C.) to (T +10° C.) or a temperature region from ($T_1$−100° C.) to ($T_1$+10° C.).

The above rapid heating is initiated from room temperature. If necessary, the coal blend may be preheated at 100 to 300° C. or alternately may be dried, followed by rapid heating.

In the present invention, the softening initiation temperature is a value as measured with a fluidity measuring device using Gieseler plastometer specified in JIS 8801. The non-slightly-caking coal is a coal having a maximum fluidity log (MF/DDPM) of 0.3 to 2.0 as measured with a fluidity measuring device using Gieseler plastometer specified in JIS 8801 and an average vitrinite reflectance of 0.3 to 1.0.

Therefore, in the process according to one aspect of the present invention, a blast furnace coke is produced by rapidly heating a coal blend comprising 10 to 30% by weight of a non-slightly-caking coal having softening initiation temperature T with the balance consisting of a caking coal having a softening initiation temperature $T_0$ ($T_0 \leqq T+40$° C.) at a rate of $1\times10^3$ to $1\times10^{6}$° C./min to a temperature region from (T −60° C.) to (T +10° C.) wherein T represents the softening initiation temperature of the non-slightly-caking coal; or rapidly heating a non-slightly-caking coal having softening initiation temperature T and a caking coal having softening initiation temperature $T_1$ separately at a rate of $1\times10^3$ to $1\times10^{6}$° C./min to a temperature region from (T −100° C.) to (T +10° C.), wherein T represents the softening initiation temperature of the non-slightly-caking coal, or a temperature region from $T_1$−100° C. to $T_1$+10° C., wherein $T_1$ represents the softening initiation temperature of the caking coal, blending the heated non-slightly-caking coal with the heated caking coal to prepare a coal blend comprising 10 to 30% by weight of the non-slightly-caking coal with the balance consisting of the caking coal; and charging the coal blend into a coke oven where the coal blend is carbonized.

In the process according to another aspect of the present invention, a blast furnace coke is produced by classifying the above coal blend into a fine coal having a particle diameter of not more than 0.3 mm and a coarse coal having a diameter exceeding 0.3 mm; rapidly heating the fine coal and the coarse coal separately to a temperature region from (T −60° C.) to (T +10° C.) wherein T represents the softening initiation temperature of the non-slightly-caking coal; hot-molding the rapidly heated fine coal having a particle diameter of not more than 0.3 mm under a pressure of 5 to 2000 kg/cm$^2$; blending the molded coal with the rapidly heated coarse coal having a particle diameter exceeding 0.3 mm; and charging the coal blend into a coke oven where the coal blend is carbonized. In this case, the process may be practiced such that the non-slightly-caking coal and the caking coal are separately classified in advance, a fine coal having a particle diameter of not more than 0.3 mm of the non-slightly-caking coal is blended with a fine coal having a particle diameter of not more than 0.3 mm of the caking coal, and the coal blend is rapidly heated under the above conditions and then hot-molded.

BRIEF DESCRIPTION OF THE DRAWINGS

FIGS. 3(A), (B), and (C) are flow diagrams of the process for making a coke according to the present invention;

BEST MODE FOR CARRYING OUT THE INVENTION

Figure 1:
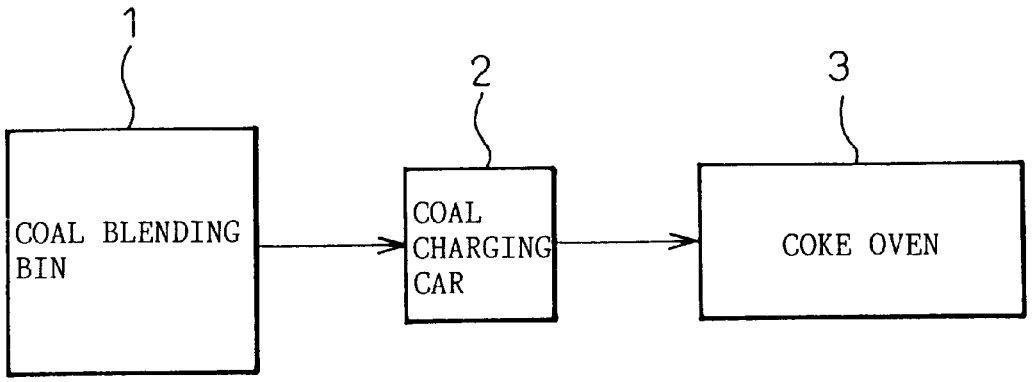
Fig. 1 PRIOR ART
FIG. 1 is a flow diagram of the conventional process for making a coke.
Figure 2:
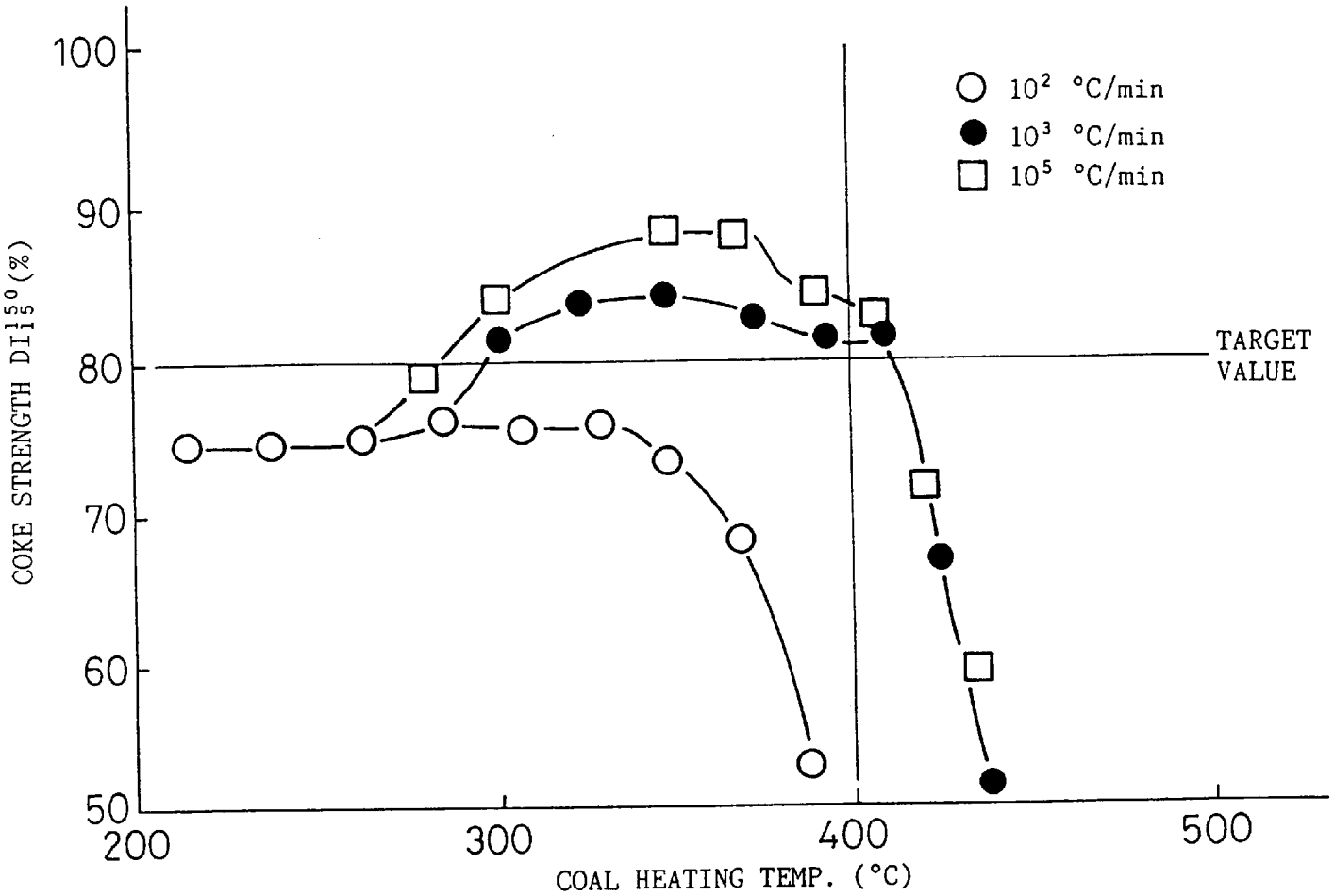
FIG. 2 is a diagram showing the relationship between the heating temperature and heating rate of a non-slightly-caking coal and the coke strength, demonstrating the effect of the present invention.

The best mode for carrying out the invention will be described.

For example, coals to be used, which have been controlled to a particle size of not more than 3 mm, that is, a non-slightly-caking coal and a caking coal, may be dried according to need. Depending upon the coals used, they may be treated in the form of a coal blend when the difference in thermal plastic temperature between the coals is less than 40° C. A system suitable for use in rapid heating is a fluidized bed, a gas stream bed or the like in consideration of the heating rate $1\times10^3$ to $1\times10^{6}$° C./min. When the heating rate is lower than $1\times10^{3}$° C./min, no effect of improved the caking property can be expected. In the present invention, since coal particles having a diameter of not more than 3 mm are handled, a fine coal fraction is excessively heated. This problem can be solved by providing a multi-stage gas stream bed and treating the fine coal fraction in a first-stage gas stream bed. The step by drying the coal also may use the gas stream bed. The heated coal is charged into a coke oven where it is carbonized. During heating of the coal and until the heated coal is charged into the coke oven, the oxygen concentration is preferably kept at less than 1% and, if possible, at less than 0.1%.

When the process of the present invention involves the step of hot molding, the coal used is controlled to a particle diameter of not more than 3 mm and then classified into fine particles having a diameter of not more than 0.3 mm and coarse particles having a diameter exceeding 0.3 mm. When the non-slightly-caking coal is classified into a fine coal and a coarse coal with the particle diameter 0.1 to 0.5 mm as the central diameter, particularly with the particle diameter not more than 0.3 mm as the central particle diameter, the caking property of the fine coal is remarkably deteriorated. Therefore, in the present invention, a pulverized coal having a particle diameter of not more than 0.3 mm is used as a fine coal, while a pulverized coal having a particle diameter exceeding 0.3 mm is used as a coarse coal. In the actual process, dry classification using a cyclone is preferred. After the classification, the coal is rapidly heated in a fluidized bed or a gas stream bed, and the heated fine coal is hot-molded. The hot molding may be suitably performed by roll molding using a double roll press or by briquetting using a briquetting machine. A flake prepared by roll molding or a briquette prepared by briquetting is suitable as the molded product.

Regarding the size of the molded product, preferably, the size of the flake is approximately 1 to 15 mm×15 mm×1 to 10 mm in thickness, and the size of the briquette is not more than 25 cc in volume. When the size of the molded product exceeds 25 cc, coking of the molding product per se occurs rather than combination of the molded product with other coal particles followed by coking of the combined product, adversely affecting the coke strength.

The heating may be suitably performed by a method wherein the interior of the roll is directly heated by electrical heating, an exhaust gas, a combustion gas or the like or a method wherein a heated gas is blown into a molding machine. In the latter method, the concentration of oxygen in the heating gas to be blown is preferably less than 1% and, if possible, less than 0.1%. The heated coal is blended with the hot-molded product, and the coal blend is charged into a coke oven where the coal blend is carbonized.

FIGS. 3(A), (B), and (C) are flow diagrams of the process according to the present invention.

As shown in FIG. 3(A), dried caking coal and non-slightly-caking coal are blended with each other in a blending bin 4, and the coal blend is rapidly heated in a gas stream bed at a rate of $1\times10^3$ to $1\times10^{6}$° C./min to a temperature region from (T −60° C.) to (T +10° C.) wherein T represents the softening initiation temperature T of the non-slightly-caking coal. The temperature of the coal within the gas stream bed may be regulated by the temperature and amount of the gas introduced. Specifically, it may be regulated by the residence time of particles determined by the diameter of coal particles and the superficial velocity of the introduced gas. The flow rate of the gas introduced may vary depending upon the height and diameter of the gas stream bed. A combustion gas is used as the gas to be introduced. For example, when a coal having a particle diameter of not more than 3 mm is treated, a fine coal is excessively heated. Therefore, in this case, a multi-stage gas stream bed 5 is provided as the gas stream bed, and the fine coal is rapidly heated in a first-stage gas stream bed and separately by means of a cyclone, followed by rapid heating of the coarse coal in a second- or later stage gas stream bed. The heated fine coal and the heated coarse coal are stored in a heated coal hopper 6 and then charged into a coke oven 3 wherein the coal is carbonized. The heated coal may be kept at a temperature of not more than (the softening initiation temperature of the coal +10° C.), until the heated coal is charged into the coke oven 3. If possible, the coal is preferably kept in a temperature region from (the softening temperature of the coal −60° C.) to (the softening temperature of the coal −10° C.), offering better results.

As shown in FIG. 3(B), a caking coal and a non-slightly-caking coal, which have been optionally dried and charged respectively into a blending bin 4-1 and a blending bin 4-2, may be rapidly heated separately in respective gas stream beds 5, 5 at a rate of $1\times10^3$ to $1\times10^{6}$° C./min to a temperature region from (T −100° C.) to (T +10° C.), wherein T represents the softening initiation temperature of the non-slightly-caking coal, or a temperature region from ($T_1$−100° C.) to ($T_1$+10° C.) wherein $T_1$ represents the softening initiation temperature of the caking coal. The temperature of the coal within the gas stream bed may be regulated by the temperature and amount of the gas introduced. Specifically, it may be regulated by the residence time of particles determined by the diameter of coal particles and the superficial velocity of the introduced gas. The flow rate of the gas introduced may vary depending upon the height and diameter of the gas stream bed. A combustion gas is used as the gas to be introduced. For example, when a coal having a particle diameter of not more than 3 mm is treated, a fine coal is excessively heated. Therefore, in this case, multi-stage gas stream beds 5, 5 are provided as the gas stream bed, and the fine coal is rapidly heated in a first-stage gas stream bed and separately by means of a cyclone, followed by rapid heating of the coarse coal in a second- or later stage gas stream bed. These heated coals are stored in a heated coal hopper 6 and then charged into a coke oven 3 wherein the coal is carbonized. The heated coal may be kept at a temperature of not more than (the softening initiation temperature of the non-slightly-caking coal +10° C.), until the heated coal is charged into the coke oven 3. If possible, the coal is preferably kept in a temperature region from (the softening temperature of the non-slightly-caking coal −100° C.) to (the softening temperature of the non-slightly-caking coal −10° C.), offering a better effect.

As shown in FIG. 3(C), a dried non-slightly-caking coal alone may be rapidly heated in a gas stream bed at a rate of $1\times10^3$ to $1\times10^{6}$° C./min to a temperature region from (T −100° C.) to (T +10° C.). The temperature of the coal within the gas stream bed may be regulated by the temperature and amount of the gas introduced. Specifically, it may be regulated by the residence time of particles determined by the diameter of coal particles and the superficial velocity of the introduced gas. The flow rate of the gas introduced may vary depending upon the height and diameter of the gas stream bed. A combustion gas is used as the gas to be introduced. For example, when a coal having a particle diameter of not more than 3 mm is treated, a fine coal is excessively heated. Therefore, in this case, a multi-stage gas stream bed 5 is provided as the gas stream bed, and the fine coal is rapidly heated in a first-stage gas stream bed and separated by means of a cyclone, followed by rapid heating of coarse coal in a second- or later stage gas stream bed. Further, in this embodiment, a caking coal, which does not need to be rapidly heated, is used. Therefore, the caking coal need not be heated, and, even though it is heated for the production of a high temperature coal, the heating rate may not be high. The caking coal and the non-slightly-caking coal are then stored in a heated coal hopper 6 and then charged into a coke oven 3 where the coal is carbonized. The heated coal may be kept at a temperature of not more than (the softening initiation temperature of the coal +10° C.), until the heated coal is charged into the coke oven 3. If possible, the coal is preferably kept in a temperature region from (the softening temperature of the coal −100° C.) to (the softening temperature of the coal −10° C.), offering a better effect.

Figure 4A:
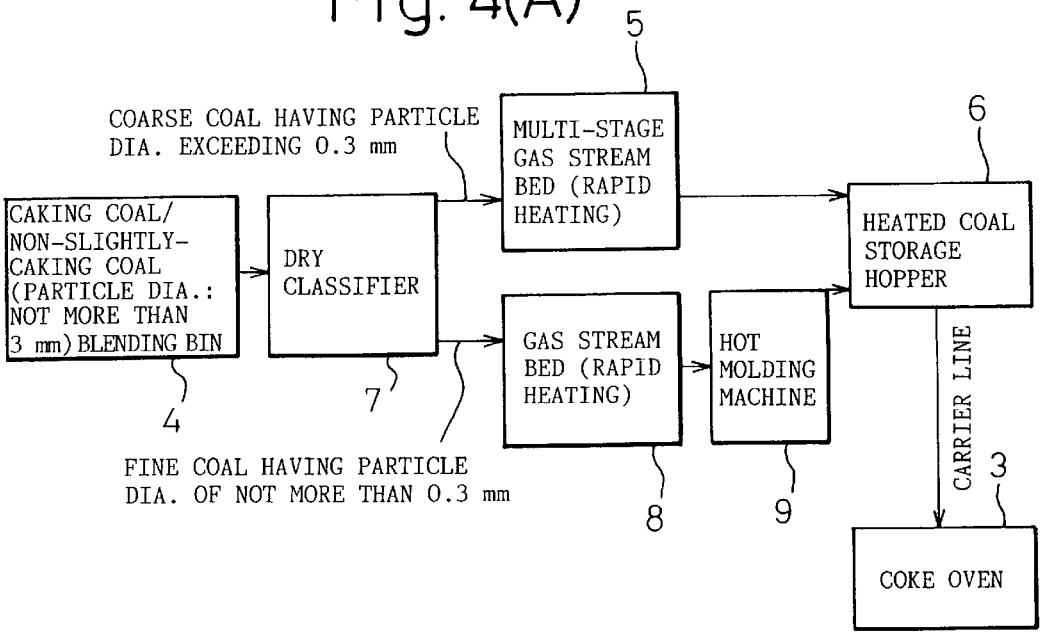
FIGS. 4(A) and (B) are flow diagrams of the coke making process, according to the present invention, involving the step of hot molding.

FIGS. 4(A) and (B) are flow diagrams of the process, according to the present invention, involving the step of hot molding.

As shown in FIG. 4(A), a caking coal is blended with a non-slightly-caking coal in a blending bin 4, and the coal blend is dry-classified by means of a dry classifier 7 into a fine coal having a particle diameter of not more than 0.3 mm and a coarse coal having a particle diameter exceeding 0.3 mm. The fine coal and the coarse coal are heated respectively in a gas stream bed 8 and a multi-stage gas stream bed 5 at a heating rate of $1\times10^3$ to $1\times10^{6°}$ C./min to a temperature region from (T −60° C.) to (T +10° C.) wherein T represents the softening initiation temperature of the non-slightly-caking coal. The temperature of the coal within the gas stream bed may be regulated by the temperature and amount of the gas introduced. Specifically, it may be regulated by the residence time of particles determined by the diameter of coal particles and the superficial velocity of the introduced gas. The heated fine coal is hot-molded by means of a hot-molding machine 9. The molding temperature is preferably in a temperature region from (T −60° C.) to (T +10° C.) wherein T represents the softening initiation temperature of the non-slightly-caking coal. When the molding temperature exceeds a value of (the softening initiation temperature of the non-slightly-caking coal +10° C.), the coal is unfavorably resolidified resulting in semicoking. This causes the caking property to be lost at the time of carbonization in the coke oven chamber, making it impossible to create a combination of the coals with each other. Therefore, the production of good coke cannot be expected. The molding pressure is 5 to 2000 kg/cm$^2$. When the molding pressure is lower than 5 kg/cm$^2$, the yield of the molded product is lowered. On the other hand, when it exceeds 2000 kg/cm$^2$, the molded product is cracked resulting in lowered yield of the molded product. Further, in this case, the molded product is expanded during carbonization, leading to high expansion pressure. The high expansion pressure deteriorates the quality of coke and, at the same time, accelerates the loss of coke oven body. The coarse coal and the molded product are stored in a heated coal hopper 6 and charged into a coke oven 3, followed by carbonization. The heated coal may be kept at a temperature of not more than a value of (the softening initiation temperature of the non-slightly-caking coal +10° C.), until the heated coal is charged into the coke oven. If possible, the coal is preferably kept in a temperature region from (the softening temperature of the non-slightly-caking coal −60° C.) to (the softening temperature of the non-slightly-caking coal −10° C.), offering better results.

Figure 4B:
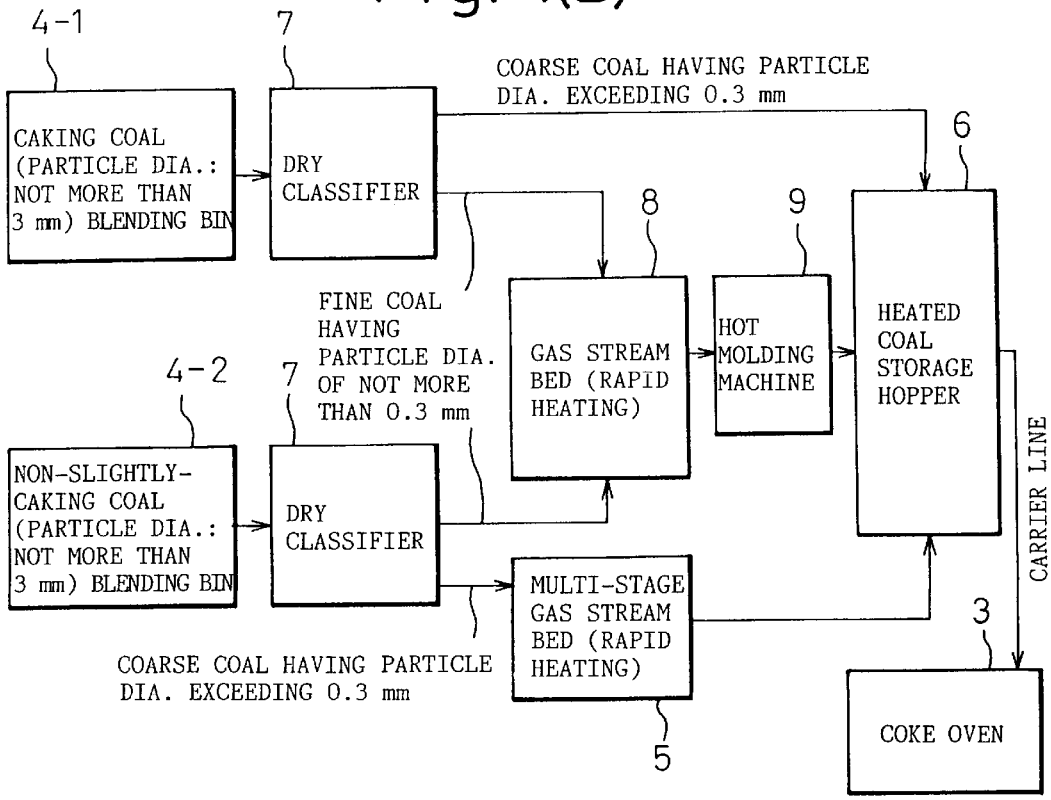

As shown in FIG. 4(B), a caking coal, which need not be rapidly heated, and a non-slightly-caking coal may be charged respectively into a blending bin 4-1 and a blending bin 4-2. These coals are separately dry-classified by means of a dry classifier 7 into a fine coal having a particle diameter of not more than 0.3 mm and a coarse coal having a particle diameter exceeding 0.3 mm. The fine coal of the caking coal is blended with the fine coal of the non-slightly-caking coal, and the fine coal blend and the coarse coal of the non-slightly-caking coal are heated respectively in a gas stream bed 8 and a multi-stage gas stream bed 5 at a rate of $1\times10^3$ to $1\times10^{6°}$ C./min to a temperature region from (T −60° C.) to (T −10° C.) wherein T represents the softening temperature of the non-slightly-caking coal. The temperature of the coal within the gas stream bed may be regulated by the temperature and amount of the gas introduced. Specifically, it may be regulated by the residence time of particles determined by the diameter of coal particles and the superficial velocity of the introduced gas. The coarse coal of the caking coal, in this embodiment, need not be heated, and, even though it is heated for the production of a high temperature coal, the heating rate may not be high. The heated fine coal is hot-molded by means of a hot-molding machine 9. The molding temperature is preferably in a temperature region from (T −60° C.) to (T +10° C.) wherein T represents the softening initiation temperature of the non-slightly-caking coal. When the molding temperature exceeds a value of (the softening initiation temperature of the non-slightly-caking coal +10° C.), the coal is unfavorably resolidified resulting in semicoking. This causes the caking property to be lost at the time of carbonization in the coke oven chamber, making it impossible to create a combination of the coals with each other. Therefore, the production of good coke cannot be expected. The molding pressure is 5 to 2000 kg/cm$^2$. When the molding pressure is lower than 5 kg/cm$^2$, the yield of the molded product is lowered. On the other hand, when it exceeds 2000 kg/cm$^2$, the molded product is cracked resulting in lowered yield of the molded product. Further, in this case, the molded product is expanded during carbonization, leading to high expansion pressure. The high expansion pressure deteriorates the quality of coke and, at the same time, accelerates the loss of coke oven body. The coarse coal and the molded product are stored in a heated coal hopper 6 and then charged into a coke oven 3, followed by carbonization. The heated coal may be kept at a temperature of not more than a value of (the softening initiation temperature of the non-slightly-caking coal +10° C.), until the heated coal is charged into the coke oven. If possible, the coal is preferably kept in a temperature region from (the softening temperature of the non-slightly-caking coal −60° C.) to (the softening temperature of the non-slightly-caking coal −10° C.), offering a better results.

EXAMPLES

Figure 5:
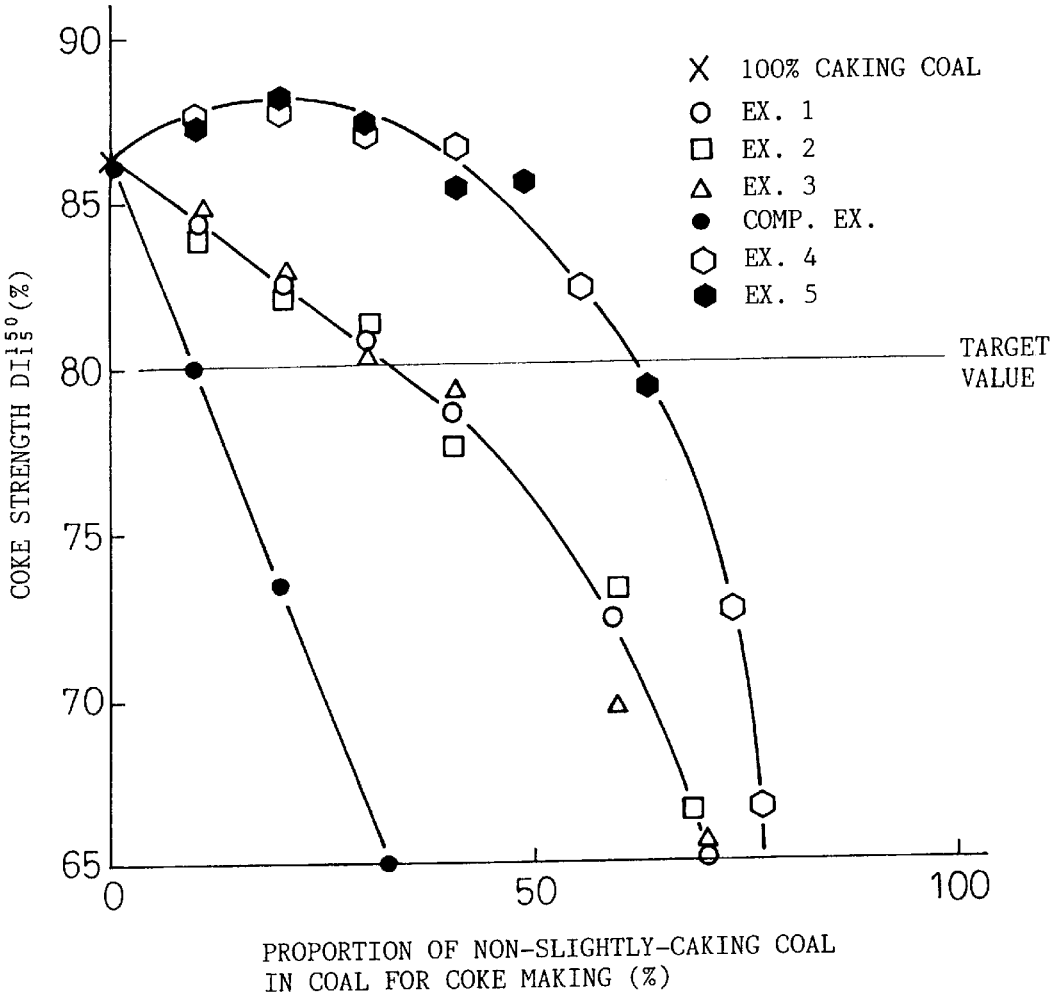
FIG. 5 is a diagram showing the relationship between the proportion of a non-slightly-caking coal used and the coke strength for the process of the present invention and the conventional process.

A coking coal A and a non-slightly-caking coal B having properties specified in Table 1 were blended together in varied blending ratios, cokes were produced from the coal blends according to the process of the present invention in a try-out plant and according to the conventional process (comparative example) involving the addition of tar as a caking additive, and the strength of cokes produced according to the process of the present invention, in comparison with that of cokes produced according to the conventional process, is shown in FIG. 5. The coke strength was expressed in terms of JIS drum index $DI^{150}_{15}$ (%) of coke (150 revolutions, ≧15 mm index %) used in the measurement of a blast furnace coke specified in JIS-K2151.

TABLE 1

| | | Gieseler fluidity test | | | |
|---|---|---|---|---|---|
| | VM (%) | Softening initiation temp. | Max. fluidity temp. | Max. fluidity, log (MF/DDPM) | Solidification temp. |
| Coal A: caking coal | 24.8 | 411° C. | 459° C. | 2.7 | 504° C. |
| Coal B: non-slightly-caking coal | 33.0 | 398° C. | 433° C. | 1.0 | 454° C. |

In Example 1 of the present invention, according to a process flow diagram shown in FIG. 3(A), a coal blend of the caking coal A with the non-slightly-caking coal B was rapidly heated in a multi-stage gas stream bed at a rate of $10^{4°}$ C./min to a temperature (about 400° C.) about 2° C. above the softening initiation temperature of the coal B, and the heated coal was carbonized in a coke oven to prepare a coke. In Example 2 of the present invention, according to a process flow diagram shown in FIG. 3(B), the caking coal A and the non-slightly-caking coal B were rapidly heated separately in a multi-stage gas stream bed at a rate of $10^{4°}$ C./min respectively to a temperature (about 400° C.) about 10° C. below the softening initiation temperature of the coal A and a temperature (about 400° C.) about 2° C. above the softening initiation temperature of the coal B, and the heated coals were carbonized in a coke oven to prepare a coke. In Example 3 of the present invention, according to a process flow diagram shown in FIG. 3(C), the non-slightly-caking coal B alone was rapidly heated in a multi-stage gas stream bed at a rate of $10^{4°}$ C./min to a temperature (about 400° C.) of about 2° C. above the softening initiation temperature of the coal B and then blended with the caking coal A, and the coal blend was carbonized in a coke oven to prepare a coke. In Example 4 of the present invention, according to a process flow diagram shown in FIG. 4(A), a coal blend of the caking coal A with the non-slightly-caking coal B was dry-classified at 120° C. into a fine coal having a particle diameter of not more than 0.3 mm and a coarse coal having a diameter exceeding 0.3 mm, the fine coal and the coarse coal were rapidly heated in a gas stream bed at a rate of $10^{4°}$ C./min to a temperature (about 380° C.) of about 18° C. below the softening initiation temperature of the coal B, the fine coal alone was molded by means of a double roll under a pressure of 850 kg/cm$^2$, the molded product was blended with the coarse coal, and the coal blend was carbonized in a coke oven to prepare a coke. In Example 5 of the present invention, according to a process flow diagram shown in FIG. 4(B), the caking coal A and the non-slightly-caking coal B were separately dry-classified at 120° C. into a fine coal having a particle diameter of not more than 0.3 mm and a coarse coal having a particle diameter exceeding 0.3 mm, the fine coal of the caking coal A was blended with the fine coal of the non-slightly-caking coal B, and a heated coal prepared by rapidly heating the above blend in a gas stream bed at a rate of $10^{4°}$ C./min to a temperature (about 380° C.) of about 18° C. below the softening initiation temperature of the coal B was blended with a heated coal prepared by rapidly heating the coarse coal of the non-slightly-caking coal B in a gas stream bed at a rate of $10^{4°}$ C./min to a temperature (about 380° C.) of 18° C. below the softening initiation temperature of the coal B and the coarse coal of the caking coal A to prepare a coal blend which was then carbonized in a coke oven to prepare a coke.

In Comparative Example, the caking coal A and the non-slightly-caking coal B were blended together in varied blending ratios, 15% by weight of tar was added to the coal blends, and the mixtures were carbonized in a coke oven to prepare cokes.

As is apparent from FIG. 5, the strength of the cokes prepared in Examples 1, 2 and 3, when the non-slightly-caking coal was added in an amount up to 30% by weight, was higher than that of the cokes prepared in the comparative example, and was satisfactory, i.e., higher than the target value 80 $DI^{150}{}_{15}$ (%) of the coke strength, while the strength of the cokes prepared in Examples 4 and 5, when the non-slightly-caking coal was added in an amount up to 60% by weight, was higher than that of the cokes prepared in the comparative example, and was satisfactory, i.e., higher than the target value 80 $DI^{150}{}_{15}$ (%) of the coke strength.

INDUSTRIAL APPLICABILITY

As described above, according to the present invention, rapid heating of a coal at a rate of $1\times10^3$ to $1\times10^{6°}$ C./min to a temperature region from (T −60° C.) [or (T −100° C.)] to (T +10° C.), wherein T represents the softening initiation temperature of the coal, improves the caking property of the coal and, even when a non-slightly-caking coal is used in an amount up to 30% by weight, can offer a coke strength substantially equal to the coke strength attained by the conventional process using a caking coal. Further, heating of a fine particle fraction of a coal at a rate of $1\times10^3$ to $1\times10^{6°}$ C./min to a temperature region from (T −60° C.) [or (T −100° C.)] to (T +10° C.), wherein T represents the softening initiation temperature of the coal, followed by hot molding to prepare a molded product can improve the caking property of the coal and, even when a non-slightly-caking coal is used in an amount up to 60% by weight, can offer a coke strength substantially equal to the coke strength attained by the conventional process using a caking coal.

Accordingly, the blending ratio of the non-slightly-caking coal can be markedly increased as compared with that in the conventional process, resulting in marked reduction of the cost of coal used for making a blast furnace coke.

Further, since charge of the coal into a coke oven is performed at a coal temperature region from (the softening temperature of the coal −60° C.) [or (the softening temperature of the coal −100° C.)] to (the softening temperature of the coal +10° C.), a marked improvement in productivity of coke can be achieved over the conventional process.

Furthermore, hot molding can prevent scattering of a fine particle fraction of a coal during handling, realizing environmentally friendly coke production.

Thus, the present invention, by virtue of various effects, is fully worthy to be industrially utilized.

We claim:

1. A process for making a blast furnace coke, comprising the steps of:

rapidly heating a coal blend comprising 10 to 30% by weight of a non- to slightly-caking coal characterized by a softening initiation temperature of $T_1$; and the balance consisting of a caking coal characterized by a softening initiation temperature of $T_0$, where $T_0 \leqq T_1+40°$ C.; wherein said heating is at a rate of $1\times10^3$ to $1\times10^{6°}$ C./min to a temperature region from $T_1-60°$ C.) to ($T_1+10°$ C.); and charging the heated coal blend into a coke oven where the coal blend is carbonized.

2. A process for caking a blast furnace coke, comprising the steps of:

rapidly heating a non- to- slightly-caking coal characterized by a softening initiation temperature of $T_1$ and a caking coal characterized by a softening initiation temperature of $T_0$ separately at a rate of $1\times10^3$ to $1\times10^{6°}$ C./min to a temperature region from ($T_1-100°$ C.) to ($T_1+10°$ C.), or a temperature region from ($T_0-100°$ C.) to ($T_0+10°$ C.);

blending the heated non- to- slightly-caking coal with the heated caking coal to prepare a coal blend comprising 10 to 30% by weight of the non- to- slightly-caking coal with the balance consisting of the caking coal; and charging the coal blend into a coke oven where the coal blend is carbonized.

3. A processing for making a blast furnace coke, comprising the steps of:

rapidly heating a non- to- slightly-caking coal characterized by a softening initiation temperature of $T_1$ at a rate of $1\times10^3$ to $1\times10^{6°}$ C./min to a temperature region from ($T_1-100°$ C.) to ($T_1+10°$ C.);

blending the heated non- to- slightly-caking coal with a caking coal to prepare a coal blend comprising 10 to 30% by weight of the non- to- slightly-caking coal with the balance consisting of the caking coal; and charging the coal blend into a coke oven where the coal blend is carbonized.

4. A process for making blast furnace coke, comprising the steps of:

classifying a coal blend into a coarse coal having a particle diameter exceeding 0.3 mm and a fine coal having a particle diameter of not more than 0.3 mm, the coal blend comprising 10 to 60% by weight of a non- to- slightly-caking coal characterized by a softening initiation temperature of $T_1$; and the balance consisting of a caking coal characterized by a softening initiation temperature of $T_0$, where $T_0 \leqq T_1+40°$ C.;

rapidly heating the classified coarse coal and fine coal separately at a rate of $1\times10^3$ to $1\times10^{6°}$ C./min to a temperature region from ($T_1-60°$ C.) to ($T_1+10°$ C.);

hot-molding the rapidly heated fine coal in a temperature region from ($T_1-60°$ C.) to ($T_1+10°$ C.) under a pressure of 5 to 2000 kg/cm$^2$;

blending the hot-molding coal with the rapidly heated coarse coal; and charging the coal blend into a coke oven where the coal blend is carbonized.

5. A process for making a blast furnace coke, comprising the steps of:

classifying a non- to- slightly-caking coal characterized by a softening initiation temperature of $T_1$ and a caking coal characterized by a softening initiation temperature of $T_0$ separately into a fine coal having a particle diameter of not more than 0.3 mm and a coarse coal having a diameter exceeding 0.3 mm;

blending the fine coal of the non- to- slightly-caking coal with the fine coal of the caking coal to prepare a first coal blend characterized by a softening initiation temperature of $T_2$;

rapidly heating the first coal blend at a rate of $1\times10^3$ to $1\times10^{6°}$ C./min to a temperature region from ($T_1-60°$ C.) to ($T_1+10°$ C.);

hot-molding the rapidly heated first coal blend in a temperature region from ($T_2-60°$ C.) to ($T_2+10°$ C.) under a pressure of 5 to 2000 kg/cm$^2$;

rapidly heating the coarse coal of the non- to- slightly-caking coal at a rate of $1\times10^3$ to $1\times10^{6°}$ C./min to a temperature region from ($T_1-100°$ C.) to ($T_1+10°$ C.);

blending the hot-molded coal, the rapidly heated coarse coal of the non- to- slightly-caking coal, and the coarse coal of the caking coal, optionally after preheating to a temperature region from ($T_0-100°$ C.) to ($T_0+10°$ C.), to prepare a second coal blend comprising 10 to 60% by weight of the non- to- slightly-caking coal and the fine coal of the caking coal with the balance consisting of the coarse coal of the caking coal; and charging the second coal blend into a coke oven where the coal blend is carbonized.

* * * * *